US005556288A

United States Patent [19]

Ishii et al.

[11] Patent Number: 5,556,288

[45] Date of Patent: Sep. 17, 1996

[54] PROTECTIVE COVER FOR CONNECTOR

[75] Inventors: Takashi Ishii; Toru Nagano, both of Shizuoka-ken, Japan

[73] Assignee: Yazaki Corporation, Tokyo, Japan

[21] Appl. No.: 224,719

[22] Filed: Apr. 8, 1994

Related U.S. Application Data

[63] Continuation-in-part of Ser. No. 981,849, Nov. 25, 1992, abandoned.

[30] Foreign Application Priority Data

Nov. 29, 1991 [JP] Japan ..... 3-98852 U
May 26, 1993 [JP] Japan ..... 5-123753

[51] Int. Cl.[6] ..... H01R 13/44

[52] U.S. Cl. ..... 439/135; 439/381

[58] Field of Search ..... 439/79, 135, 136, 439/147, 381, 519, 521, 892, 893

[56] References Cited

U.S. PATENT DOCUMENTS

| | | | |
|---|---|---|---|
| 3,273,104 | 9/1966 | Krol | 439/557 |
| 3,287,687 | 11/1966 | Mosher | 439/135 |
| 4,627,759 | 12/1986 | Kato et al. | 403/2 |
| 4,780,090 | 10/1988 | Sugiyama et al. | 439/247 |
| 5,215,474 | 6/1993 | Rotella | 439/892 |

FOREIGN PATENT DOCUMENTS

| | | | |
|---|---|---|---|
| 62-188188 | 8/1987 | Japan . | |
| 63-12173 | 1/1988 | Japan . | |
| 63-16149 | 5/1988 | Japan . | |
| 1-22232 | 6/1989 | Japan . | |
| 2208759 | 4/1989 | United Kingdom | 439/892 |

OTHER PUBLICATIONS

Smith, R F., "Shroud for Pinfield," Technical Digest, AT&T Technologies, No. 74, Jul. 1984, P. 31.

*Primary Examiner*—P. W. Echols
*Attorney, Agent, or Firm*—Wigman, Cohen, Leitner & Myers, P.C.

[57] ABSTRACT

A protective cover is mounted on a connector in which a plurality of terminals are received within a housing. The housing has a hood section having an opening, and electrical contact portions of the terminals are arranged in a predetermined arrangement within the hood section. The protective cover includes a cover body fitted in the opening in the hood section. The protective cover has an arrangement confirming portion for confirming whether or not the electrical contact portions are properly arranged. The arrangement confirming portion is formed so as to correspond to the arrangement of the electrical contact portions.

10 Claims, 10 Drawing Sheets

PROTECTIVE COVER FOR CONNECTOR

CROSS REFERENCE TO RELATED APPLICATION

This patent application is a Continuation-In-Part application of Ser. No. 981,849, now abandoned by ISHII, entitled PROTECTIVE COVER FOR CONNECTOR, filed on Nov. 25, 1992 and assigned to the same assignee as the present invention.

BACKGROUND OF THE INVENTION

The present invention relates to a protective cover for a connector, which is mounted on a housing opening in the connector incorporated in a wire harness, for example, for protecting a plurality of terminals within a housing from dust or dirt and the like during period of time until being assembled on a vehicle, and the like.

Conventionally, a protective cover for a connector, of the kind referred to above has been known as disclosed in Japanese Utility Model Publication No. SHO 63-16149 and Japanese Utility Model Publication No. HEI 1-22232. The protective cover disclosed in each of these publications is fitted in a hood section of a connector and is mounted on a connector body through bolts and nuts. Accordingly, it is possible to insure that the protective cover is fixed to the connector body.

Fundamentally, however, the protective cover is one which is temporarily mounted on the connector body during a period of time until a wire harness is assembled into the vehicle. Accordingly, it is better that mounting and demounting of the protective cover is easy.

Since the conventional protective cover described above is mounted on the connector body by the use of the bolts and the nuts, it is required to execute tightening and demounting of the nuts when the protective cover is mounted and demounted. Accordingly, the conventional protective cover is troublesome or complicated in mounting and demounting thereof. For this reason, it has conventionally been desired to improve a mounting structure of the protective cover.

By the way, electrical contact portions of male terminals projecting within a hood section of a multiple connector are arranged in the predetermined proper arrangement. However, there is a case where the electrical contact portions of some of the male terminals are deformed so as to interfere with the proper arrangement when the male terminals are inserted in a terminal accommodating chamber. When this connector is covered by a protective cover in such a manner that some of terminals are deformed, and such connector is transported and is mated with the partner connector without noticing the deformation of the electrical contact portions, the deformed electrical contact portions of the male terminals cannot mate with female terminals of the partner connector so that a failure of an electrical connection occurs.

Therefore, an operator looks into the hood section to inspect the deformation of the electrical contact portions. However, it is very difficult to detect visually whether or not the arrangement of the electrical contact portions is a proper one.

SUMMARY OF THE INVENTION

It is an object of the present invention to provide a protective cover for a connector in which an operator can easily detect whether or not an arrangement of male terminals is a proper one.

It is another object of the present invention to provide a protective cover which is easy to mount and dismount while producing a sufficient engaging force.

To achieve these objects of the present invention, there is provided a protective cover mounted on a connector in which a plurality of terminals are received within a housing, the housing has a hood section having an opening, and electrical contact portions of the terminals are arranged in a predetermined arrangement within the hood section, the protective cover comprising:

a cover body fitted in the opening in the hood section; and an arrangement confirming portion for confirming whether or not the electrical contact portions are properly arranged, the arrangement confirming portion being formed so as to correspond to the arrangement of the electrical contact portions.

Preferably, the arrangement confirming portion includes a plurality of terminal confirming holes through which an operator can look at tops of the electrical contact portions, the terminal confirming holes being arranged so as to correspond to a proper arrangement of the electrical contact portions.

The arrangement confirming portion may include a plurality of terminal inserting holes into which tops of the electrical contact portions are inserted, the terminal inserting holes being arranged so as to correspond to a proper arrangement of the electrical contact portions.

The arrangement confirming portion may include side walls surrounding the terminal inserting holes so as to protect the tops of the electrical contact portions inserted into the terminal inserting holes.

In the configuration described above, since the arrangement confirming portion is formed so as to correspond to the arrangement of the electrical contact portions, an operator can easily detect whether or not the electrical contact portions are properly arranged by covering the hood section with the protective cover.

Further, the cover body may include a flexible fitting section to be fitted in the opening of the hood section and formed with a second engaging section engaged with a first engaging section of the connector.

With the arrangement described above, since the cover body can be flexed, it is possible to mount and demount the protective cover on and from the connector extremely easily. Moreover, since the protective cover has the second engaging section which is engaged with the first engaging section of the connector, it is possible to insure that the mounting state or condition is maintained or retained.

DETAILED DESCRIPTION OF THE PREFERRED EMBODIMENTS

First Embodiment

Figure 1:
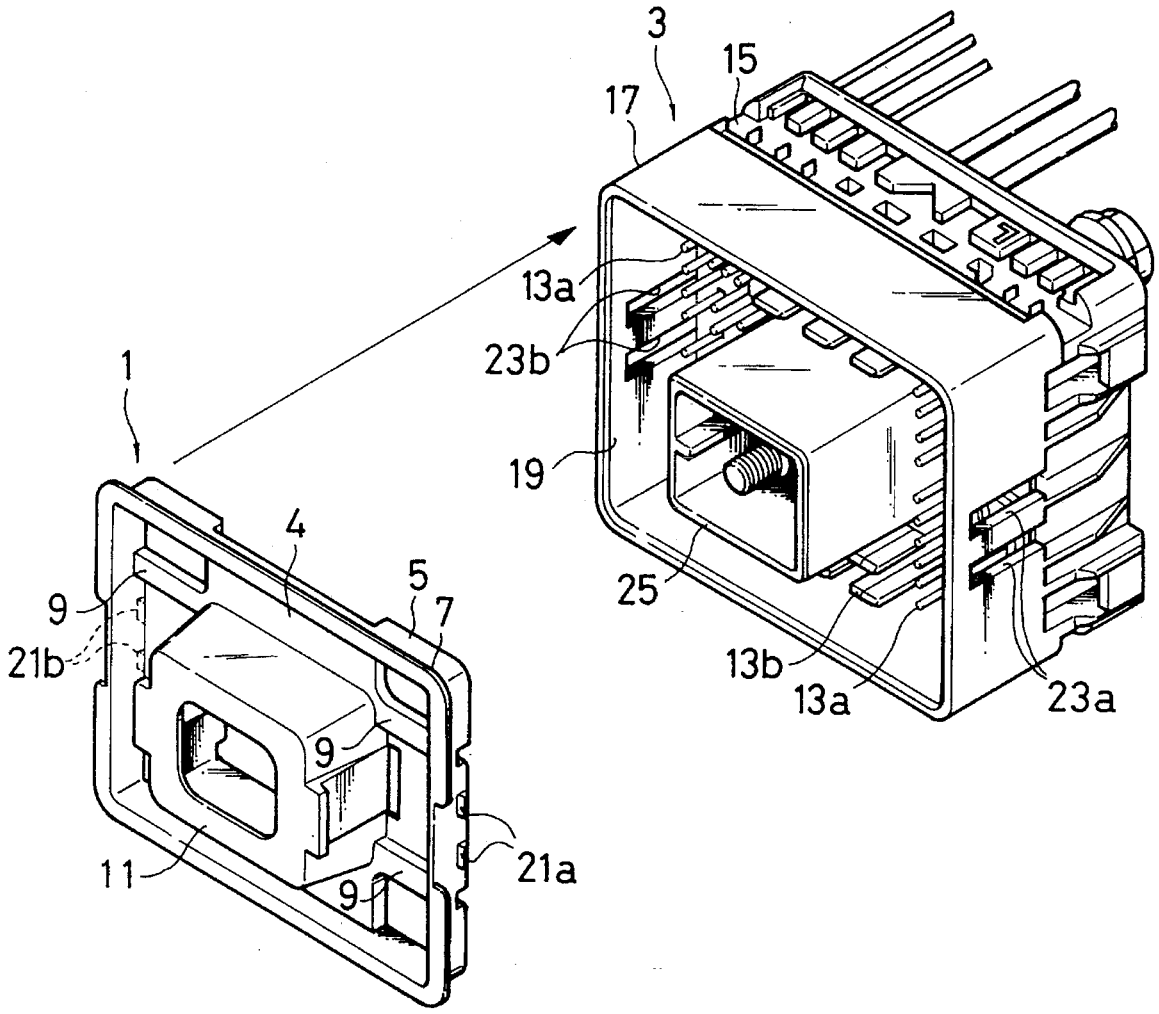
FIG. 1 is a perspective view showing a protective cover according to a first embodiment of the invention, together with a female connector.

Referring first to FIG. 1, there is shown a protective cover 1 in relationship with a female connector 3. The protective cover 1 is integrally molded from a material having an elasticity such as resin or the like and is provided with a cover body 4, a fitting section 5, a flange section 7, a plurality of ribs 9 and a projection 11. The fitting section 5 is one fitted in an inner periphery of an opening 19 in a hood section 17 adjacent to a housing 15 of the female connector 3 which receives or accommodates therein a plurality of terminals 13*a* and 13*b*. Two pairs of engaging projections 21*a* and 21*b* are provided respectively on left- and right-hand both sides of an outward surface of the fitting section 5. Two pairs of engaging sections 23*a* and 23*b* for engaging respectively with the two pairs of engaging projections 21*a* and 21*b* are provided respectively on left- and right-hand both sides of an inward surface of the opening in the hood section 17.

The ribs 9 serve to maintain rigidity of the protective cover 1 formed or molded by resin. The projection 11 is a portion which is grasped by fingers of an operator when the protective cover 1 is mounted in the opening 19, and which is fitted in a tube 25 within the housing 15. The flange section 7 is abutted against the opening 19 when the fitting section 5 is fitted in the inner periphery of the opening 19.

The female connector 3 is assembled with a wire harness (not shown), and mounts the protective cover 1 in the opening 19 in the hood section 17 when the wire harness is carried to an outfitting line of a vehicle.

The invention will be described in further detail by the use of schematic figures of FIGS. 2 and 3. When the fitting section 5 of the protective cover 1 is opposed against the opening 19 in the female connector 3 and is pushed thereinto as it is, the engaging projections 21*a* and 21*b* are engaged respectively with the engaging sections 23*a* and 23*b* through elastic deformation of the cover body 4 and the fitting section 5, and the flange section 7 is abutted against the opening 19. Thus, mounting of the protective cover 1 is completed.

The terminals 13*a* and 13*b* within the housing 15 and the like can be protected from dust or dirt and other obstacles or the like by such protective cover 1, when the wire harness is carried to the outfitting line of the vehicle.

Figure 2:
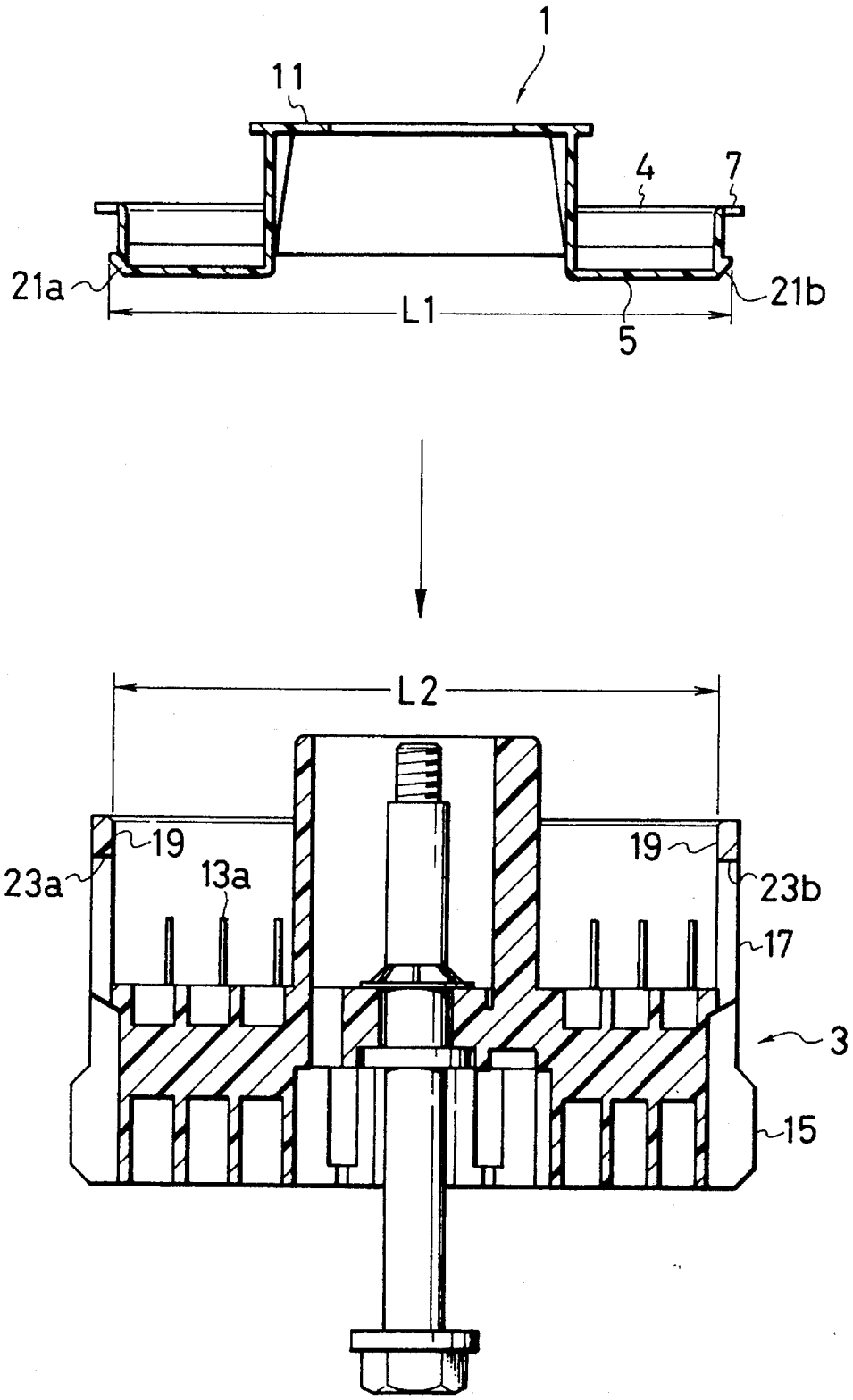
FIG. 2 is a schematic cross-sectional view showing a condition prior to the fact that the protective cover shown in FIG. 1 is mounted.
Figure 3:
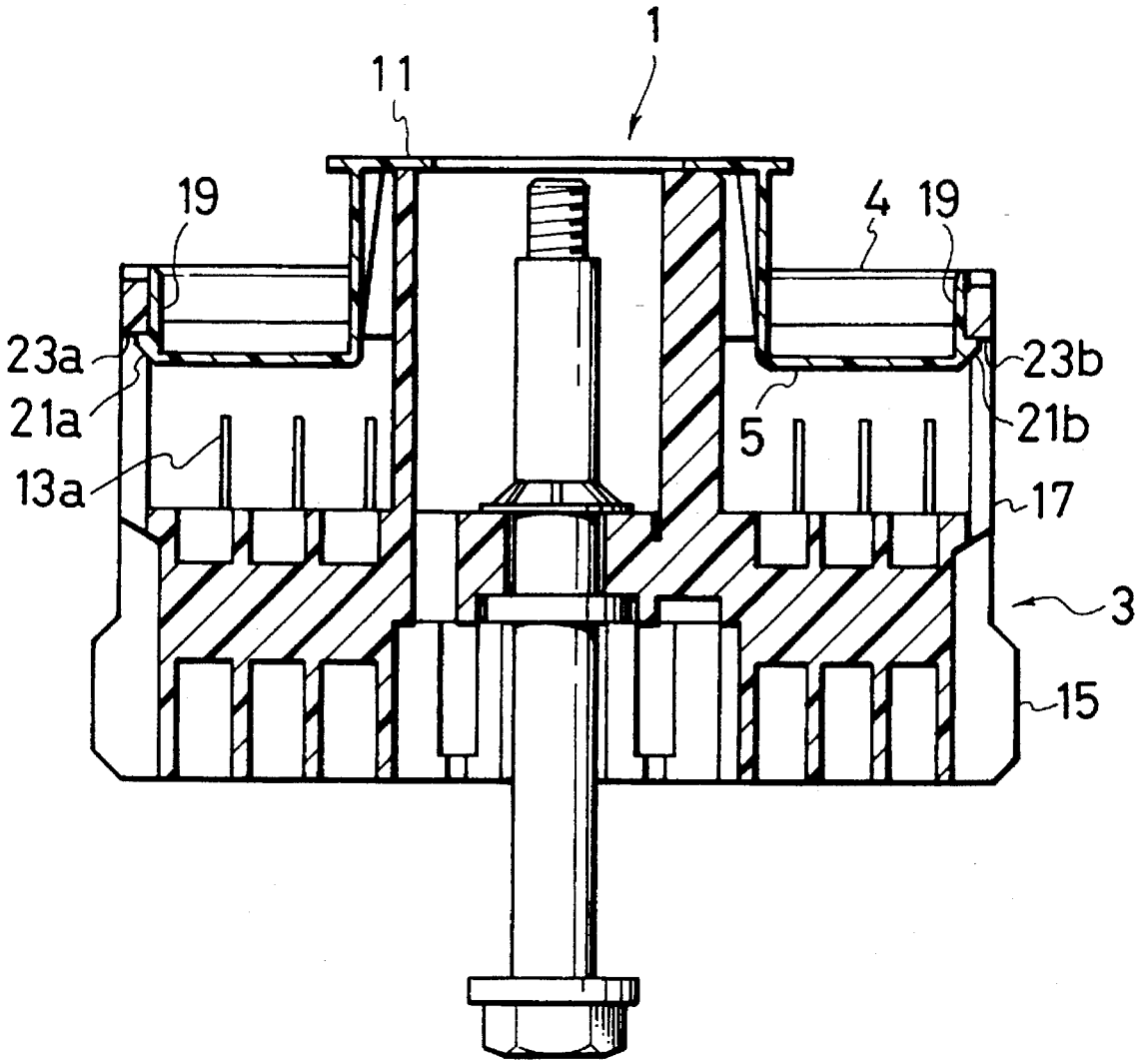
FIG. 3 is a cross-sectional view showing a condition in which the protective cover illustrated in FIG. 1 is completed in mounting.

By the way, it has been known that an engaging force of the protective cover 1 with respect to the opening 19 is in proportion substantially to a dimensional difference $b=L_1-L_2$ in FIG. 2. Specifically, b denotes a shearing width between a width dimension $L_1$ between forward ends of the respective engaging projections 21*a* and 21*b* and a width dimension $L_2$ of the opening 19. If the shearing width b is in accordance with the design, it is possible to engage the protective cover 1 with the opening 19 with a predetermined force.

In this manner, according to the first embodiment of the invention, only grasping of the projection 11 by the operator to press the protective cover 1 into the opening 19 makes it possible to mount the protective cover 1 on the female connector 3 extremely easily. Further, since the engaging projections 21*a* and 21*b* are engaged respectively with the engaging sections 23*a* and 23*b*, it is possible to secure that a mounting condition is maintained and retained. Moreover, at the time of demounting, the operator grasps the projection 11 and pulls out the protective cover 1, whereby it is possible to demount the protective cover 1 from the female connector 3 extremely easily.

Second Embodiment

Figure 4:
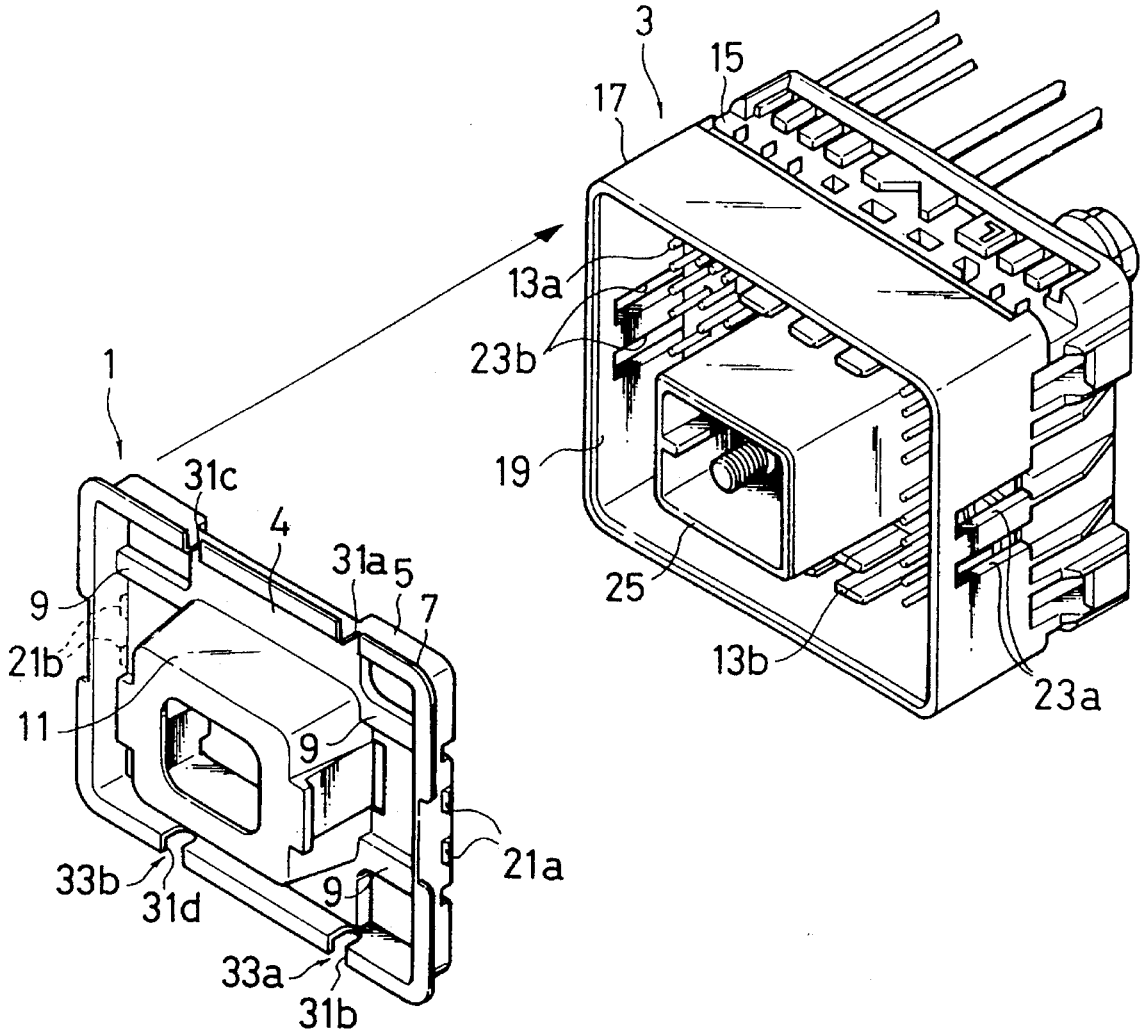
FIG. 4 is a perspective view showing a protective cover according to a second embodiment of the invention, together with a female connector.

FIG. 4 is a perspective view showing a protective cover 1 according to a second embodiment of the invention, together with a female connector 3, and shows a state or condition similar to that illustrated in FIG. 1. Accordingly, the same or identical reference numerals are applied to the same or identical components or parts, and the duplicate description will be omitted.

In the second embodiment of the invention, a plurality of slits 31*a*, 31*b*, 31*c* and 31*d* are provided in portions extending from a flange section 7 to a fitting section 5 at locations on both left- and right-hand sides of a projection 11. The slits 31*a* and 31*b* are so provided as to vertically face toward each other at one of the left- and right-hand sides of the projection 11, while the slits 31*c* and 31*d* are so provided as to vertically face toward each other at the other side. Specifically, the slits 31*a* and 31*b* are formed respectively in opposed sides of the rectangular cover body 1. Likewise, the slits 31*c* and 31*d* are formed respectively in opposed sides of the cover body 1. The slits 31*a* and 31*c* are formed in the same or identical side, which the slits 31*b* and 31*d* are formed in the identical side.

Accordingly, a cover body 4 has a pair of flexible sections 33*a* and 33*b* on both left- and right-hand both sides of the projection 11, the flexible sections 33*a* and 33*b* include the slits 31*a* ad 31*b* and the slits 31*c* and 31*d*. The cover body 4 is capable of being bent such that a width between both left- and right-hand sides of the outside surface of the fitting section 5 is reduced by flexure of the flexible sections 33*a* and 33*b*. In addition, the flexible sections 33*a* and 33*b* have a predetermined or prescribed self-restoring force sufficient to retain or maintain the protective cover 1 with respect to the female connector 3.

Figure 5:
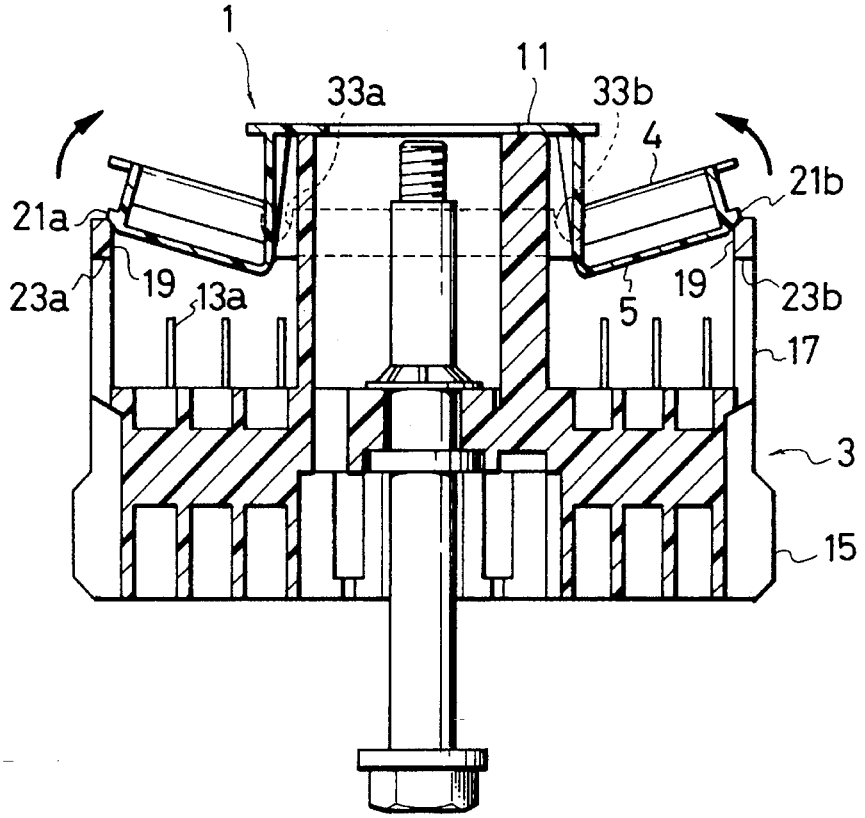
FIG. 5 is a schematic cross-sectional view showing a condition during mounting of the protective cover illustrated in FIG. 4.
Figure 6:
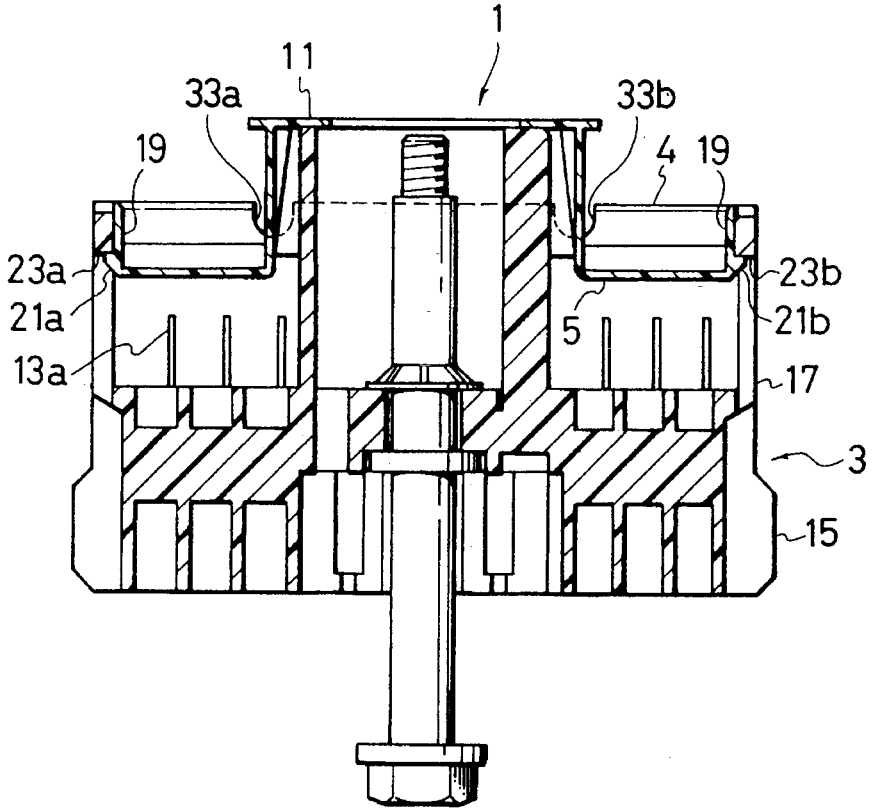
FIG. 6 is a schematic cross-sectional view showing a condition in which the protective cover illustrated in FIG. 4 has been completed in mounting.

When the protective cover 1 is mounted in an opening 19 in the female connector 3, an operator has or takes the projection 11 to oppose the fitting section 5 against the opening 19, and presses the fitting section 5 with a predetermined load or weighting as it is. Then, the both left- and right-hand sides of the fitting section 5 receive reaction forces from both left- and right-sides of the opening 19. The cover body 4 is bent as shown in FIG. 5 by the flexible sections 33*a* and 33*b* such that the width between the both left- and right-hand sides on the outside surface, that is, the width between the forward ends of the respective engaging projections 21*a* and 21*b* is reduced. Thus, it is possible to press the fitting section 5 into the inner periphery of the opening 19 with a small force as it is. When the engaging projections 21*a* and 21*b* are engaged respectively with two pairs of engaging sections 23*a* and 23*b* by this pressing, a force tending to bend the cover body 4 is released so that the cover body 4 is brought to a condition illustrated in FIG. 6 by the self-restoring force of the flexible sections 33*a* and 33*b*. Thus, the engaging projections 21*a* and 21*b* are engaged respectively with the engaging sections 23*a* and 23*b* with a prescribed engaging force.

Furthermore, when the protective cover 1 is demounted, the projection 11 is grasped and is pulled out. Then, the left- and right-hand engaging projections 21*a* and 21*b* receive the reaction forces from the respective engaging sections 23*a* and 23*b*. The cover body 4 is slightly bent into a direction reverse to that illustrated in FIG. 5, through the flexible sections 33*a* and 33*b*. Thus, it is possible to demount the protective cover 1 easily.

In this manner, by provision of the flexible sections 33*a* and 33*b*, the shearing width indicated by a difference between the width between the forward ends of the respective engaging projections 21*a* and 21*b* and the lateral width of the opening 19 is made variable. Since the shearing width is made small at mounting and demounting, and the shearing width is made large at engaging, mounting and demounting operation is easy. Even if there is variation in size or dimension on manufacturing in the protective cover 1 and the like, it is possible to relieve an influence on the engaging force between the engaging projections 21*a* and 21*b* and the engaging sections 23*a* and 23*b*. Accordingly, reliable engagement prevents coming-off or falling-off during transferring of the wire harness from occurring, making it possible to insure that a plurality of terminals 13*a* and 13*b* of the female connector 3 is protected from dust or dirt and other obstacles.

Third Embodiment

Figure 7:
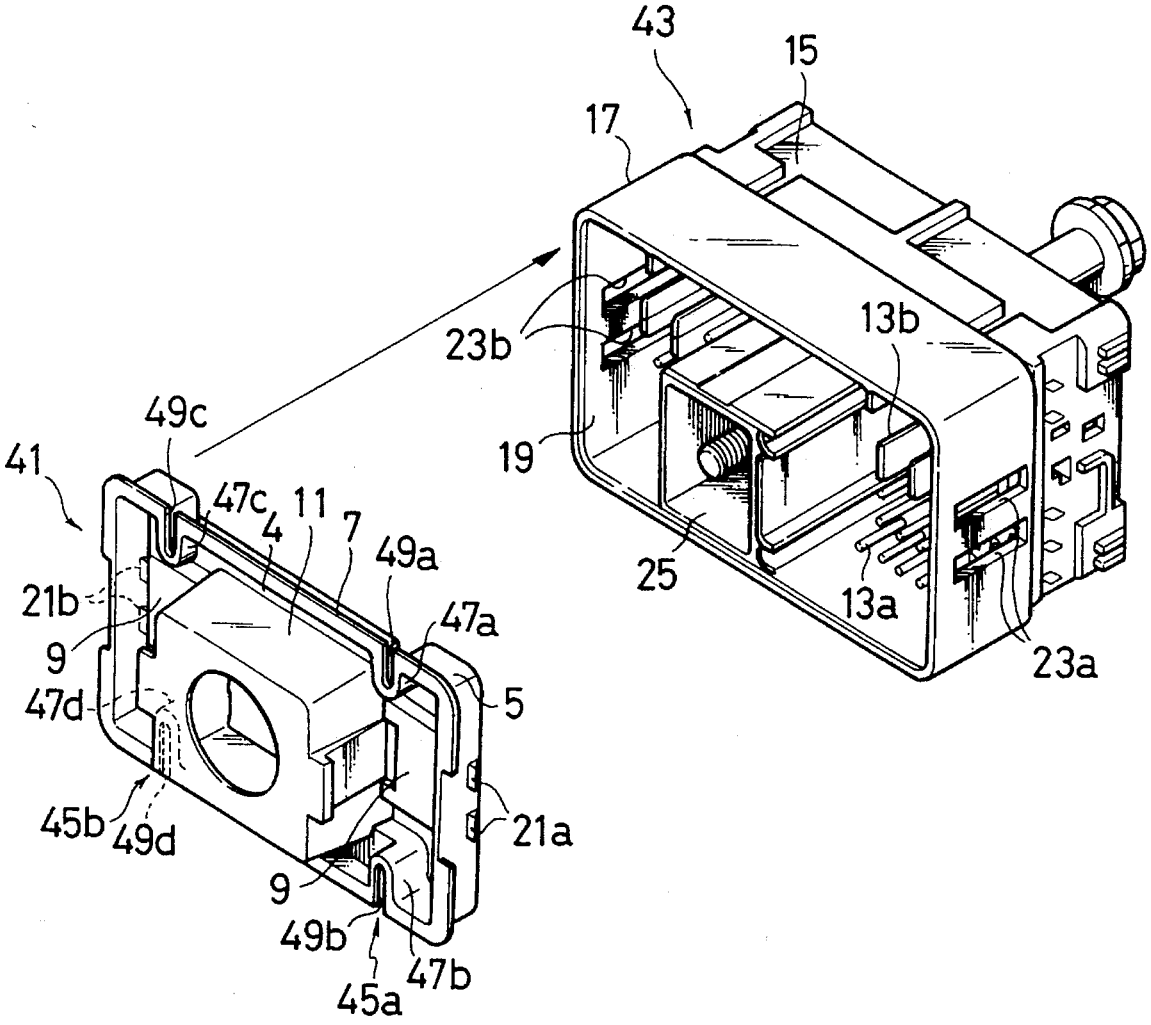
FIG. 7 is a perspective view showing a protective cover according to a third embodiment of the invention, together with a female connector.

FIG. 7 is a perspective view showing a protective cover 41 according to a third embodiment of the invention, together with a female connector 43 of an another configuration. In this third embodiment, the female connector 43 has a slightly flat or more elongated configuration as compared with the female connector 3 shown in FIG. 4. In conjunction with this, accordingly, the protective cover 41 is also brought to a flat configuration. The third embodiment of the invention differs in structure by virtue of a pair of flexible sections 45*a* and 45*b* from the first and second embodiments described previously.

Other structures are substantially similar to those shown in FIG. 4. The same reference numerals are applied to the similar structures, and the duplicate description will be omitted.

Specifically, in the third embodiment, a plurality of recesses 47*a*, 47*b*, 47*c* and 47*d* are formed in a fitting section 5 so as to extend the entire thickness direction thereof at both left- and right-hand sides of a projection 11. Slits 49*a*, 49*b*, 49*c* and 49*d* corresponding respectively to the recesses 47*a*, 47*b*, 47*c* and 47*d* are provided in a flange section 7. One of flexible sections 45*a* is formed by the recesses 47*a* and 47*b* and the slits 49*a* and 49*b*, while the other flexible section 45*b* is formed by the recesses 47*c* and 47*d* and the slits 49*c* and 49*d*.

Accordingly, the third embodiment can produce functional advantages similar to those of the aforesaid first and second embodiments and, in addition thereto, durability is improved because the third embodiment is arranged such that the slits are not provided at the fitting section 5, but the recesses 47*a*~47*d* are provided in the fitting section 5.

In connection with the above, the above-described third embodiment has been described with respect to a case where the protective cover is attached to or mounted on the female connector. However, the protective cover may be formed as a protective cover for being mounted on a male connector assembled on the wire harness. In addition, the arrangement may be such that the protective cover is mounted on a connector on the side of a vehicle connected to a connector of the wire harness, and such that it is dust proof for a period of time until the wire harness is assembled.

Fourth Embodiment

Figure 8:
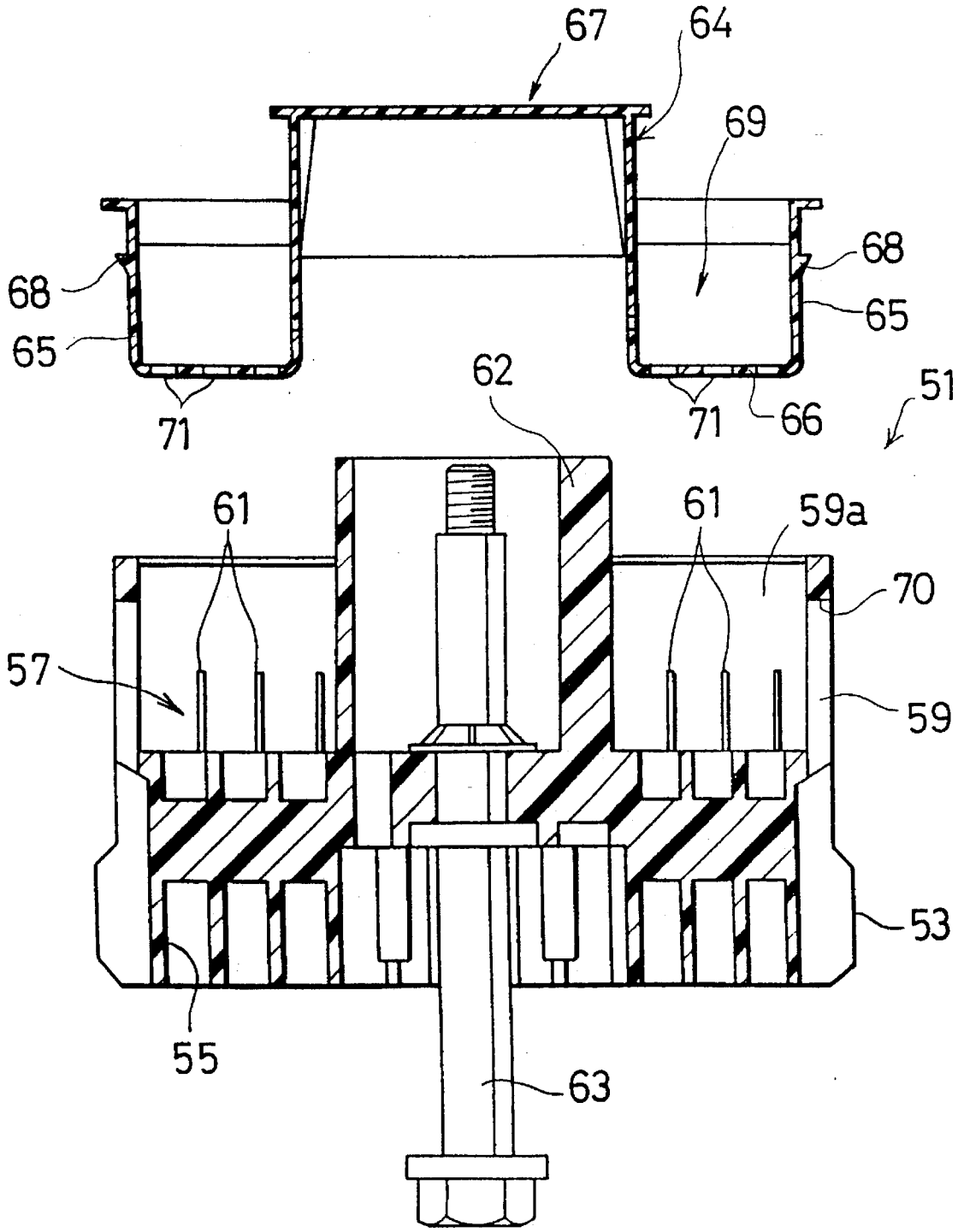
FIG. 8 is a cross-sectional view showing a protective cover according to a fourth embodiment of the present invention.
Figure 9:
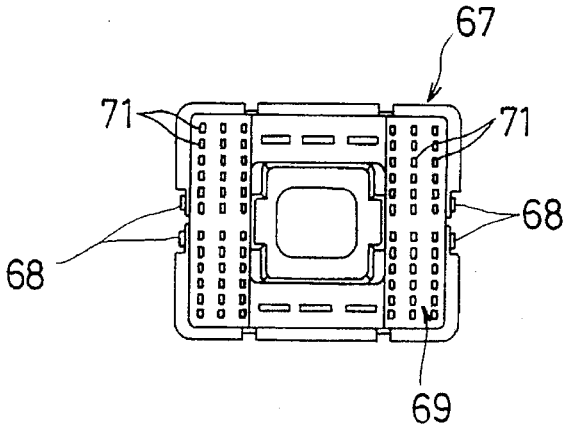
FIG. 9 is a plan view showing a protective cover shown in FIG. 8.

The fourth embodiment of a protective cover for a connector according to the present invention is shown in FIGS. 8 and 9. FIG. 8 is a cross sectional view showing a multiple connector and a protective cover thereof, and FIG. 9 is a plan view showing the protective cover.

This multiple connector 51 has a connector housing 53 forming a lot of terminal accommodating chambers 55 in which male terminals 57 are received, respectively. The connector housing 53 is integrally formed with a hood section 59 in which electrical contact portions 61 of the male terminals 57 project. This hood section 59 is mated with a connector body of the partner connector, while the electrical contact portions 61 of the male terminals 57 are mated with female terminals of the partner connector to be electrically connected to each other.

The opening 59*a* of the hood section 59 of the multiple connector 51 is covered by a protective cover 67 to prevent dust and the like from invading the hood section 59 and an external force from being exerted on the electrical contact portions 61 of the male terminals 57. The protective cover 67 is formed with a fitting wall 64 for fitting on the wall 62 surrounding the bolts 63 at the center portion of the protective cover 67. A bottom 66 of the protective cover 67 is formed around the fitting wall 64 and is connected to an outer fitting wall 65 formed with a pair of projections 68 on the outer peripheral surface thereof. These projections 68 secure the protective cover 67 to the hood section 59 by engaging with the engaging hole 70 formed in the hood section 59. The fitting wall 64, the bottom 66 and the outer fitting wall 65 form a cover body. The cover body may be flexible as described in the first to third embodiments.

The protective cover 67 is provided with an arrangement confirming portion 69 for confirming the arrangement condition of the electrical contact portions 61 of the male terminals 57. The arrangement confirming portion 69 corresponds to the arrangement of the electrical contact portions 61 projecting within the hood section 59 of the connector 51. The arrangement confirming portion 69 is formed with a plurality of terminal confirming holes 71 which are arranged so as to correspond to the arrangement of the male terminals 57 and through which the top of the electrical contact portion 61 can be seen.

Figure 10:
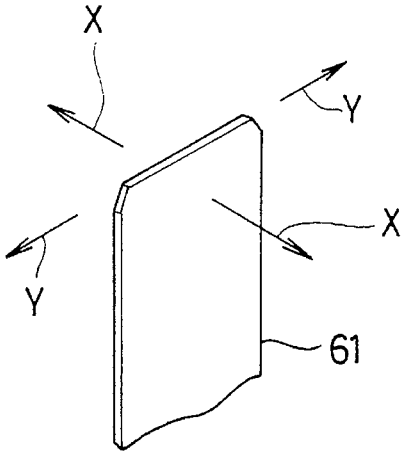
FIG. 10 is a perspective view showing a top of an electrical contact portion of a male terminal.
Figure 11:
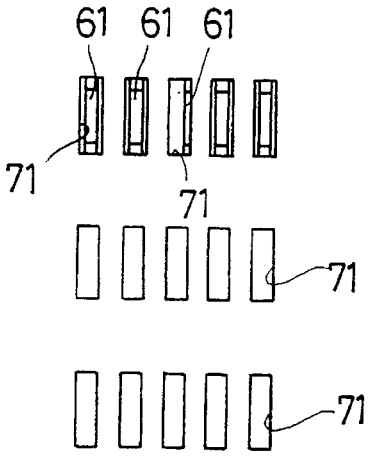
FIG. 11 is a plan view showing a terminal confirming holes and the tops of the electrical contact portions.

Each of the electrical contact portions 61 has a plate-like shape and is hard to be deformed in Y-direction and apt to be deformed in X-direction as shown in FIG. 10. The terminal confirming hole 71 forms a slit extending in Y-direction of the electrical contact portion 61. When an operator looks at the top of the male terminal 57 through the terminal confirming hole 71, the operator can see the top of the electrical contact portion 61 through the terminal confirming hole 71 in the case where the male terminal 57 is not deformed; conversely the operator can confirm a shift of the the top of the electrical contact portion 61 from the terminal confirming hole 71 in the case where the electrical contact portion 61 is deformed in the X-direction, and thus it is possible to easily detect the deformation of the electrical contact portion 61.

The male terminal 57 presents a metallic color because generally the male terminal 57 is made of metal. The protective cover 67 is colored so as to be easily distinguishable from the metallic color of the male terminal 57 and so as to make it easy to detect the shift of the top of the electrical contact portion 61.

Fifth Embodiment

Next, the fifth embodiment of the present invention will be described hereinafter. The basic structure of the fifth embodiment, is similar to that of the fourth embodiment and therefore the repeating explanation will be omitted.

Figure 12:
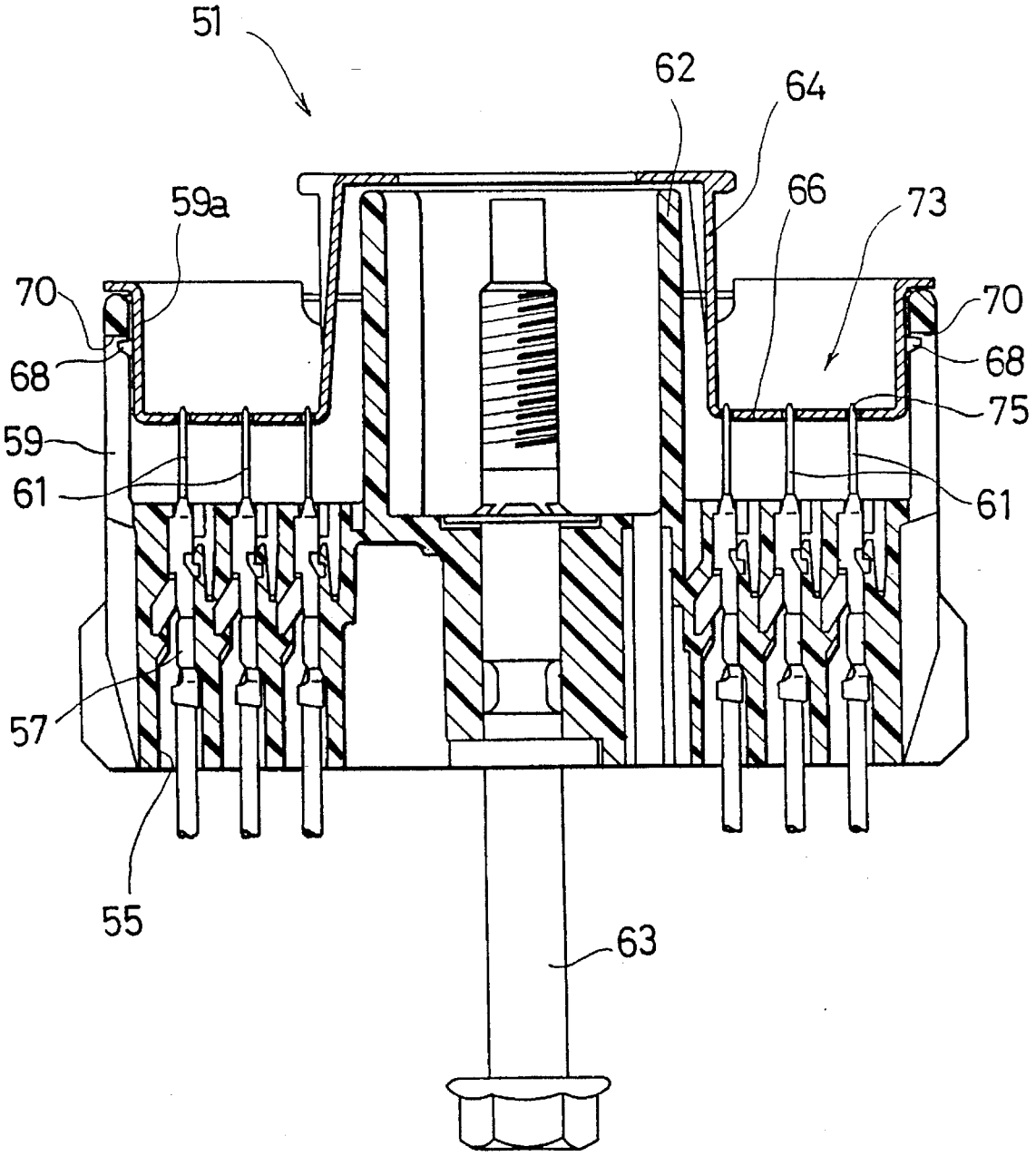
FIG. 12 is a cross-sectional view showing a protective cover according to a fifth embodiment of the present invention.

As shown in FIG. 12, an arrangement confirming portion 73 is arranged so as to correspond to the arrangement of the male terminals 57. The arrangement confirming portion 73 of this embodiment is provided in the bottom 66 with a plurality of terminal inserting holes 75 in which the tops of the electrical contact portions 61 of the male terminals 57 are inserted.

In this embodiment, an operator can easily detect the deformation of the male terminal 57 when the tops of some electrical contact portions 61 cannot be inserted into the terminal inserting holes 75 upon covering the hood section 59 with the protective cover 67. In this embodiment, since the tops of the electrical contact portions 61 are inserted into the terminal inserting holes 75, proper positioning of the electrical contact portion 61 of the male terminal 57 is maintained during transportation, so that the electrical contact portions 61 are prevented from being deformed by an external force. Further, in this embodiment, since the tops of the electrical contact portions 61 are inserted into the terminal inserting holes 75, the deformation of the electrical contact portions 61 can be more easily detected as compared with the visual confirmation by the operator in the fourth embodiment.

Sixth Embodiment

Next, the sixth embodiment of the present invention will be described hereinafter. The basic structure of the sixth embodiment is similar to that of the fifth embodiment, and therefore the repeating explanation will be omitted.

Figure 13:
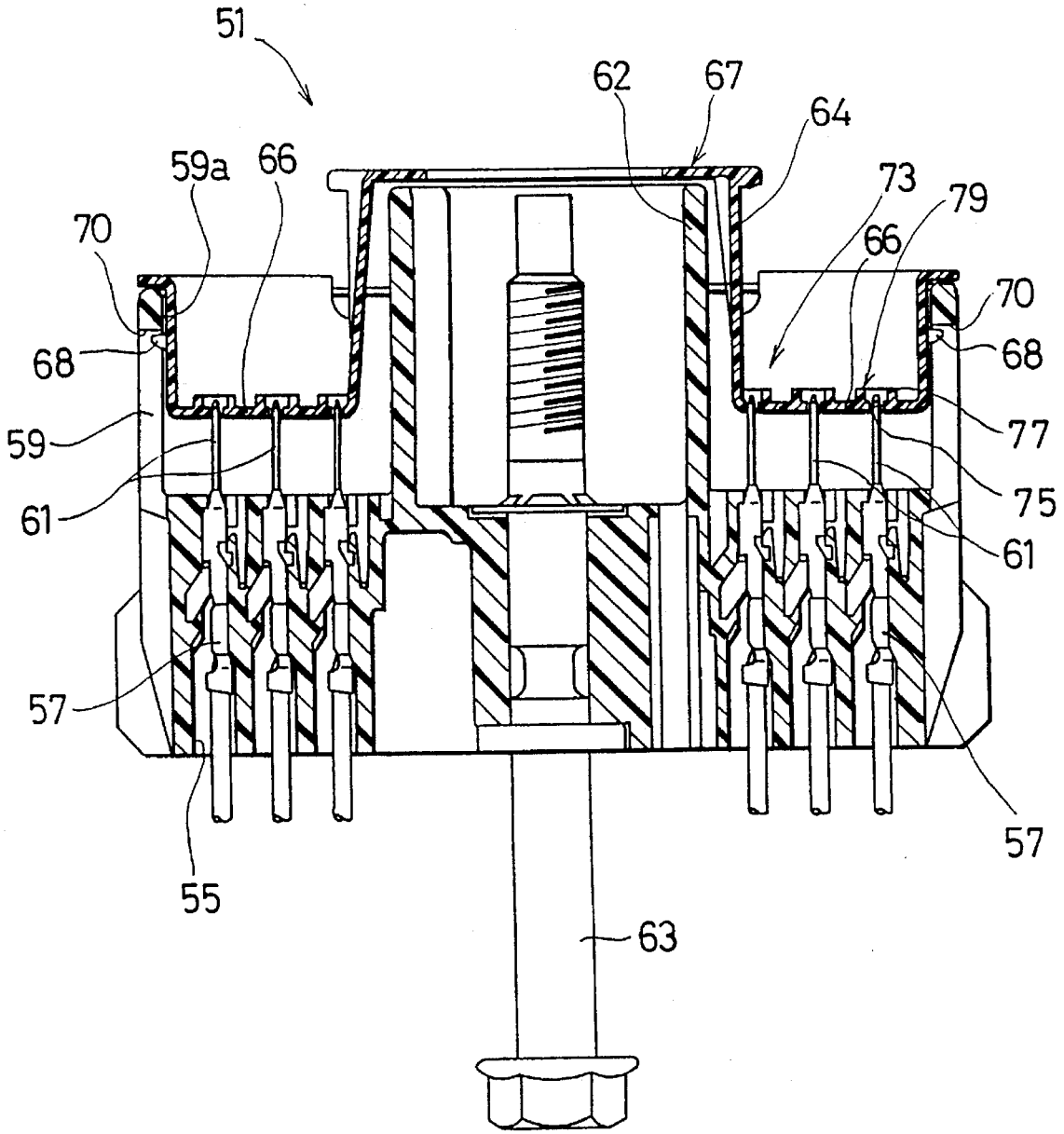
FIG. 13 is a cross-sectional view showing a protective cover according to a sixth embodiment of the present invention.

Referring to FIG. 13, an arrangement confirming portion 73 in the protective cover 67 according to this embodiment includes a plurality of terminal inserting holes 75, and tip receiving portions 79 formed with side walls 77 surrounding the terminal inserting holes 75. The tops of the electrical contact portions 61 inserted into the terminal inserting holes 75 project within the tip receiving portion 79 while penetrating the bottom 66 of the protective cover 67.

In this embodiment, similarly to the fifth embodiment, an operator can easily detect the deformation of the male terminal 57 when the tops of some electrical contact portions 61 cannot be inserted into the terminal inserting holes 75 upon covering the hood section 59 with the protective cover 67. Further, in this embodiment, the tops of the electrical contact portions 61 penetrating the bottom 66 of the protective cover 67 are protected by the side walls 77.

What is claimed is:

1. A protective cover mounted on a connector having a housing within which a plurality of terminals is received, the connector including a hood section adjacent to said housing and having an opening, wherein the terminals extend from said housing to said hood section and electrical contact portions of the terminals are arranged in a predetermined arrangement within the hood section;

said protective cover comprising a cover body fitted in the opening in the hood section, said coverbody including arrangement confirming means for confirming whether or not the electrical contact potions are arranged in the predetermined arrangement;

wherein said arrangement confirming means includes a plurality of terminal confirming holes through which an operator can view tops of the electrical contact portions, said terminal confirming holes being arranged so as to correspond to the predetermined arrangement of the electrical contact portions.

2. A protective cover mounted on a connector having a housing within which a plurality of terminals is received, the connector including a hood section adjacent to said housing and having an opening, wherein the terminals extend from said housing to said hood section and electrical contact portions of the terminals are arranged in a predetermined arrangement within the hood section;

said protective cover comprising a cover body fitted in the opening in the hood section, said cover body including arrangement confirming means for confirming whether or not the electrical contact portions are arranged in the predetermined arrangement;

wherein said arrangement confirming means comprises a plurality of terminal inserting holes into which tops of the electrical contact portions are inserted, said terminal inserting holes being arranged so as to correspond to the predetermined arrangement of the electrical contact portions.

3. A protective cover according to claim 2, wherein said arrangement confirming means further comprises side walls surrounding said terminal inserting holes so as to protect the tops of the electrical contact portions inserted into the terminal inserting holes.

4. A protective cover according to claim 3, wherein said connector comprises first engaging means disposed on the hood section for engaging said cover body, said cover body comprising a flexible fitting section to be fitted in the opening in the hood section and second engaging means for engaging said first engaging means to interconnect said cover body and said hood section.

5. A protective cover according to any one of claims 4 or 3, wherein said first engaging means includes an engaging recess, said second engaging means includes an engaging projection engaged with said engaging recess, and an outer dimension of said flexible fitting section including said engaging projection is formed slightly larger than an inside dimension of said opening.

6. A protective cover according to claim 3, wherein said cover body has a fitting section fitted in the opening in the hood section, and a flexible section so bendable as to reduce a width of said cover body at mounting and dismounting of said connector;

said protective cover further comprising first engaging means disposed on the hood section for engaging said cover body and second engaging means for engaging said first engaging means, said second engaging means being provided on said fitting section.

7. A protective cover according to claim 2, wherein said connector comprises first engaging means disposed on the hood section for engaging said cover body, said cover body comprising a flexible fitting section to be fitted in the opening in the hood section and second engaging means for engaging said first engaging means to interconnect said cover body and said hood section.

8. A protective cover according to claim 2, wherein said cover body has a fitting section fitted in the opening in the hood section, and a flexible section so bendable as to reduce a width of said cover body at mounting and dismounting of said connector;

said protective cover further comprising first engaging means disposed on the hood section for engaging said cover body and second engaging means for engaging said first engaging means, said second engaging means being provided on said fitting section.

9. A protective cover according to any one of claims 6 or 8, wherein said flexible section comprises a pair of slits formed in said fitting section, said slits being formed in respective opposed sides of said cover body.

10. A protective cover according to any one of claims 4 or 7, wherein said flexible fitting section includes a pair of recesses formed in opposed sides of said cover body, and said cover body includes a flange extending from said fitting section, and wherein a slit is formed in said flange corresponding to said recess.

* * * * *